US005360371A

United States Patent [19]

Bartimote

[11] Patent Number: 5,360,371

[45] Date of Patent: Nov. 1, 1994

[54] MATERIAL HANDLING APPARATUS AND METHOD

[75] Inventor: John K. Bartimote, Traralgon, Australia

[73] Assignee: Peter James Coffey, Australia

[21] Appl. No.: 820,905

[22] PCT Filed: Jul. 17, 1990

[86] PCT No.: PCT/AU90/00305

§ 371 Date: Feb. 25, 1992

§ 102(e) Date: Feb. 25, 1992

[87] PCT Pub. No.: WO91/01184

PCT Pub. Date: Feb. 7, 1991

[30] Foreign Application Priority Data

Jul. 18, 1989 [AU] Australia ..... PJ5318

[51] Int. Cl.[5] ..... B08B 15/02

[52] U.S. Cl. ..... 454/56; 55/240; 55/385.2

[58] Field of Search ..... 55/240, 385.2; 135/93, 135/97; 134/21, 201; 454/56, 57, 63

[56] References Cited

U.S. PATENT DOCUMENTS

| | | | |
|---|---|---|---|
| 1,324,834 | 12/1919 | Lumby | 454/56 |
| 1,977,386 | 10/1934 | Holes | 454/63 X |
| 4,298,367 | 11/1981 | Descolas | 55/240 X |
| 4,670,062 | 6/1987 | Lester | 134/21 |
| 4,782,844 | 11/1988 | Hughes | 134/201 X |
| 4,809,391 | 3/1989 | Soldatovic | 454/57 X |

FOREIGN PATENT DOCUMENTS

| | | |
|---|---|---|
| 17573 | 12/1988 | Australia . |
| 0616 | 10/1987 | WIPO . |
| 11925 | 12/1989 | WIPO . |

*Primary Examiner*—Harold Joyce
*Attorney, Agent, or Firm*—Andrus, Sceales, Starke & Sawall

[57] ABSTRACT

Apparatus for handling potentially dangerous materials by an operator, comprising a work head including a main body (2) having first and second work zones therein, the first and second work zones (15, 19) being arranged adjacent one another with a transfer opening (20) therebetween. The apparatus further includes a first access opening (17) for providing access to said first work zone by the operator from externally thereof and a second access opening (21) for providing access to the second work zone (19) by the operator from externally thereof. An air flow generator (85, 86) is provided for withdrawing air from said first work zone and the apparatus further includes liquid spray means (23) comprising a plurality of spray heads (27) arranged so that liquid spray therefrom forms a plurality of liquid barriers or curtains which at least partially surround the second work zone including liquid barriers or curtains across the transfer opening (20) and second access opening (21).

13 Claims, 4 Drawing Sheets

MATERIAL HANDLING APPARATUS AND METHOD

This invention relates to a method and apparatus for use in removal of material from an article. More particularly, though not exclusively, the invention is suitable for use in the removal of material which is fibrous or particulate in nature. One example of such material is asbestos.

In applicant's International application No. PCT/AU87/00098 there is described apparatus for removing asbestos insulation from piping. This apparatus includes a spray assembly which is arranged so as to provide a fluid barrier between the work zone in which the material is placed and the operator. The spray assembly is also arranged to wet down the material in the work zone.

Whilst this apparatus has been highly successful its applications are limited in that in some instances the apparatus cannot be used with piping which is very hot. Often pipes having asbestos on them are arranged to carry hot fluid inside them so that the pipes themselves become heated. With applicants prior art apparatus, the arrangement of the spray assembly can cause problems as a result of spray contacting the pipe causing a thermal shock effect on the pipe. As a result of this, it has often been necessary to shut down the plant during the asbestos removal procedure. It will be appreciated that the cost of such shut down can be considerable.

There are other devices which are known which confine an article being treated and use an air stream to try and control the potentially dangerous materials being treated therein. Examples of such devices are described in Australian patent specification 594,578 (17573/88) and U.S. Pat. No. 4,809,391. The major disadvantage of apparatus of the type described in these specifications is that they do not provide a fully comprehensive treatment system for the potentially dangerous material.

That is to say apparatus for the type described in the aforementioned patent specifications do not provide an effective arrangement for handling and subsequently treating the pieces of material such as asbestos lagging after it has been removed from the pipe.

It is an object of the present invention to provide an improved method and apparatus for use in the removal of material from an article, which alleviates the aforementioned problem.

According to the present invention there is provided apparatus for handling potentially dangerous materials by an operator, comprising: a work head which includes a main body having first and second work zones therein, said first and second work zones being arranged adjacent one another with a transfer opening therebetween; at least one first access opening for providing access to said first work zone by said operator from externally thereof; at least one second access opening for providing access to said second work zone by said operator from externally thereof; an air flow generator for withdrawing air from said first work zone; liquid spray means comprising a plurality of spray heads arranged so that liquid spray therefrom forms a plurality of liquid barriers or curtains which at least partially surround said second work zone including liquid barriers or curtains across said transfer opening and said second access opening to prevent the escape of the potentially dangerous materials from said second work zone. The apparatus of the present invention enables potentially dangerous materials to be stripped from an article such as a pipe with a minimum danger to the operator and immediately transferred to a second safety zone where it can be treated in a relatively safe manner.

The transfer opening and the second access opening may be defined by a single opening to the second work zone between the first and second work zones. This arrangement is advantageous in that only one opening is provided in the second work zone thereby further reducing the danger of escape of material therefrom.

In one embodiment of the invention the main body may comprise a base wall, a peripheral side wall and a top with a cavity within the main body. The first and second work zones can be defined by different regions of the cavity these regions being separated by the transfer opening. Thus the two work zones are enclosed within a single structure and thereby the possibility of escape of dangerous materials into the environment is reduced. The first work zone may be defined by a first region of the cavity adjacent the top and the second work zone defined by a second region of the cavity below the first region and adjacent the base wall. This arrangement has the advantage that material will tend to fall into the second work zone from the first work zone under the influence of gravity. It will be appreciated, however, that under certain circumstances the first and second work zones could be disposed side by side.

The first access opening may be located in a first section of the peripheral side wall and adjacent or near the top. A third access opening may be provided in the first section of the peripheral side wall and below the first access opening. This third access opening can provide access to the transfer opening which as mentioned above can also define the second access opening.

A fourth access opening may be provided in a second position of the peripheral side wall opposite to the first section of said peripheral side wall. This access opening provides access to the material in the first work zone from a position opposite to the first access opening.

The spray means may comprise additional spray heads forming liquid spray barriers or curtains across other or all the access openings. Thus in the particular arrangement where access openings other than the transfer opening are disposed in the peripheral side wall the spray barriers will be directed down these sections of the wall and thereby ensuring that liquid spray onto the material within the first work zone is prevented or at least significantly reduced.

In one embodiment, the air flow generator may be arranged so that air is withdrawn from the first work zone in a region opposite to the first access openings.

The access openings may be provided with closures which close the openings when not in use. Thus the closures can define valve closures which by choosing which closure to open and close can selectively direct the air into and through the first work zone. The first work zone can be arranged to have any desired number of access openings arranged in any suitable configuration. For example, the access openings may be arranged to provide easy access to the article within the first work zone from all locations. The valve closures in this configuration ensure that at all stages air is entering the first work zone through the open access opening and the air flow is directed generally away from that access opening.

In another embodiment the main body may comprise a series of separable sections which are connectible together so as to form a single unit with the cavity therein. Desirably one of the separate sections has the second work zone therein the other sections defining various regions of the first work zone. The sections can be arranged adjacent one another so that they surround the article being treated. For example, in the treatment of a pipe having a vertical section the section may be disposed one on top of the other with the vertically disposed pipe section extending therethrough.

As mentioned earlier, the transfer opening and second access opening and/or any two or more access openings can be defined by a single opening. The spray head may be configured so that at least part of the spray produced by one of the spray heads enters the second work zone so as to wet the material therein. It is further advantageous that the spray heads forming one or more of the liquid barriers or curtains are arranged in two groups of spray heads, these groups being spaced apart from one another with the spray heads of one group facing towards the spray heads of the other group so that the spray emitted from the two groups comes into collision.

The apparatus may further include control systems for handling the contaminated air and liquid which is discharged from the work head. Desirably two individual control systems are provided, one for handling the air drawn from the first work zone and the other for handling the liquid discharged from the second work zone.

Dealing firstly with the air flow control system, air (including contaminant such as fibres and water particles) is drawn out of the work zone via one or more discharge lines and may be transferred to an interceptor in which the airborne fibre is treated, the contaminated water is contained and the air temperature is reduced.

The interceptor may be connected between the work head and the suction means, intercepting all gases, liquids and solids. Air entering the interceptor is expanded in a spray zone. The fine aerosols created in the spray zone remove residual airborne fibres by mutual attraction and interact with incoming contaminated water droplets. This reaction is further stimulated when the matter is forced into collision against a first precipitation deflection plate where cyclonic action and eddy currents are created, condensing the contaminated water and precipitating it from the air. This may be repeated in three stages to ensure that all liquids and solids are scrubbed from the air prior to the air passing to the air suction means.

The contaminated water collected in the interceptor is drawn from a storage zone in the interceptor and delivered to a liquid treatment interceptor. This interceptor separates the gas from the liquids and solids.

A filter arrangement in the interceptor separates the solids and liquid to provide water filtration whereafter.

The liquid control system for controlling liquid discharged from the second work zone includes an interceptor which separates gas from the liquids and solids. In addition the interceptor is adapted to separate the solids from the liquid. The liquid can then be passed to a final filtering interceptor for a further filtering procedure before passing to the drain or being redirected back for use in the spray heads in the work zone.

The work head may further include a discharge chute through which material within the second work zone can be discharged. This material may be discharged to a position where it can be placed in bags.

The air flow generator may be in the form of a suction fan unit fitted with a series of filters to catch any fibres caught in the air flow from the first work zone. The air flow created by the air flow generator is much larger than the pressure differential created in the second work zone.

Preferred embodiments of the invention will hereinafter be described with reference to the accompanying drawings.

Figure 1:
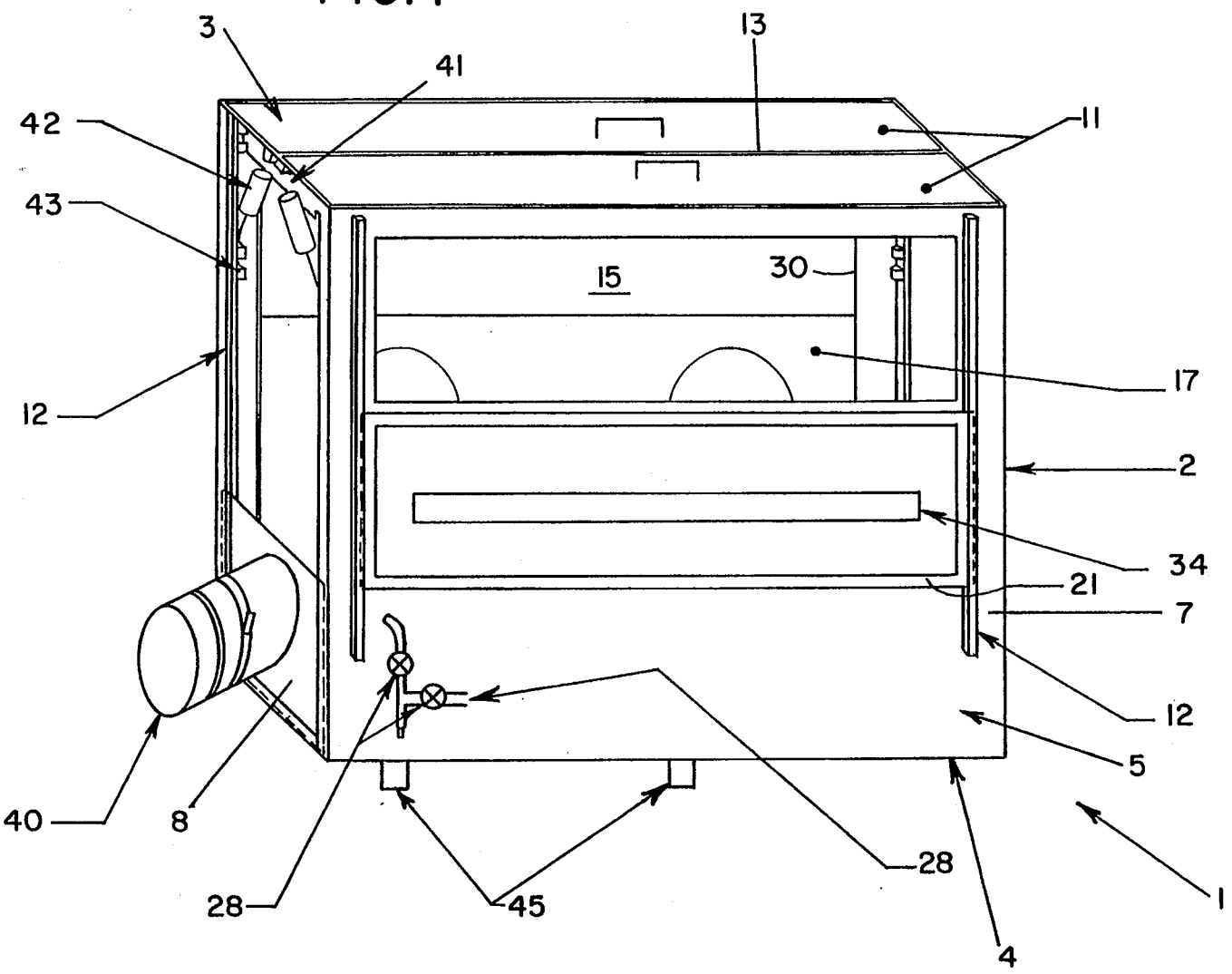
FIG. 1 is a schematic perspective view of apparatus according to the present invention with parts omitted for clarity.
Figure 1A:
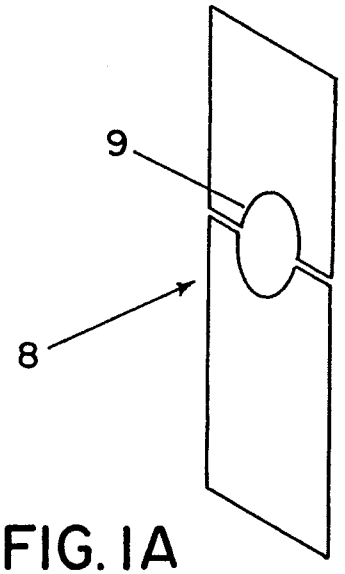
FIG. 1A shows an end wall for the apparatus.
Figure 3:
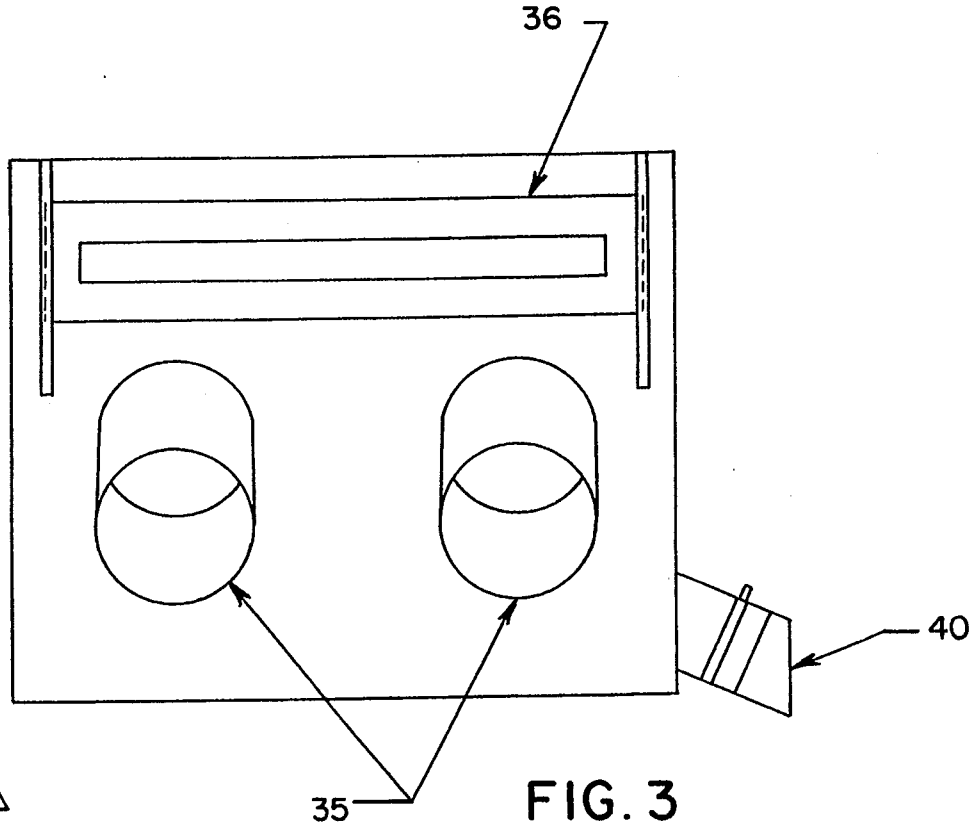
FIG. 3 is a side elevation of the apparatus shown in FIGS. 1 and 2.
Figure 2:
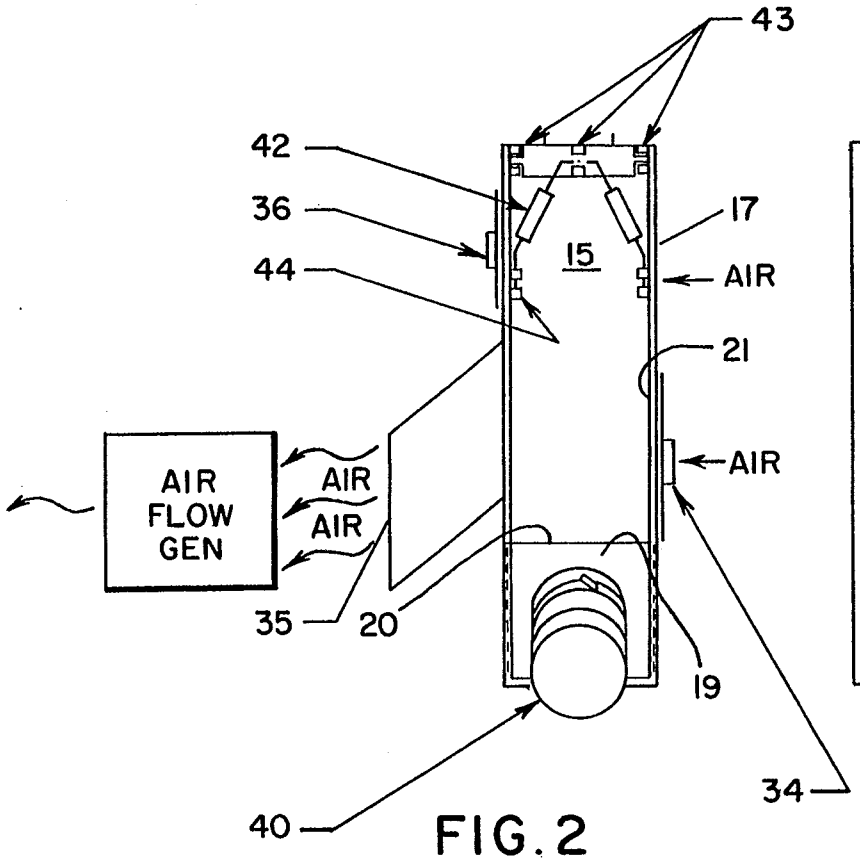
FIG. 2 is an end elevation of the apparatus shown in FIG. 1.

Referring to the drawings, the apparatus generally indicated at 1 comprises a work head which includes a main body 2 having a top 3 a bottom 4 and a peripheral side wall 5. As can be best seen in FIG. 1 the main body 2 is boxed shaped and the peripheral wall 5 includes opposed side wall sections 7 and end wall sections 8. Only part of one of the end walls have not been shown in FIGS. 1 and 2 but are best seen in FIG. 1A. Each end wall section 8 includes an opening 9 therein through which a pipe 100 can pass.

The two end wall sections 8 are formed in two parts around openings so that the pipe can be disposed within the openings 9. The two parts of the end walls 8 are adapted to by slidably received in slots 12 which enables them to be located around the pipe 100.

The main body 2 includes a top closure which comprises two parts 11 each hinged to respective side wall sections 7 with a slot or space 13 therebetween. The slot or space 13 is provided so that the apparatus can be moved along the pipe and pass or receive therethrough mounting brackets and the like.

The apparatus includes a pipe support assembly 41 which supports the work head on the pipe 100. The support assembly 41 includes a pair of rollers 42 at each end of the main body and secured thereto by mounting hinges 44. The rollers are arranged so that the work head will seat properly on the pipe 100.

The main body 2 includes a first work zone 15 in an upper region of the main body with an access opening 17 through which an operator can access the pipe within that zone of the apparatus. A second work zone 19 is provided in a lower region of the apparatus and communicates with the first work zone by way of a transfer opening 20 which also defines an access opening to the second work zone. An access opening 21 permits ease of access to opening 20. In addition, a further access opening 30 is provided on the opposite side wall section to the provide access to the first work zone from the side opposite to access opening 17. Valve closures means are provided for access openings 17, 21 and 30. As shown, two closure means are provided; a first closure 34 which is mounted for sliding movement to selectively close either access opening 17 or openings 21 and a second closure 36 sliding being mounted so as to close access opening 30.

Spray means 23 is provided which includes a spray head 24 in the first work zone 15 and includes a spray head section 24*a* which provides a spray barrier 102 across the access opening 17. The spray head 24 also includes a second spray head section 24*b* which provides a barrier at the other side wall section of the peripheral side wall 5 which provides a second fluid barrier. As best seen, the spray from these spray head sections are directed down the walls and do not impinge on pipe 100. Valves 28 control the flow of water to the various spray heads.

An air flow generator comprising plurality of suction fans (not shown) draws air through the first work zone the air being drawn through access opening 17 and out via ducts 35. The second spray head 24*b* provides a fluid barrier across the openings to these ducts 35.

Figure 4:
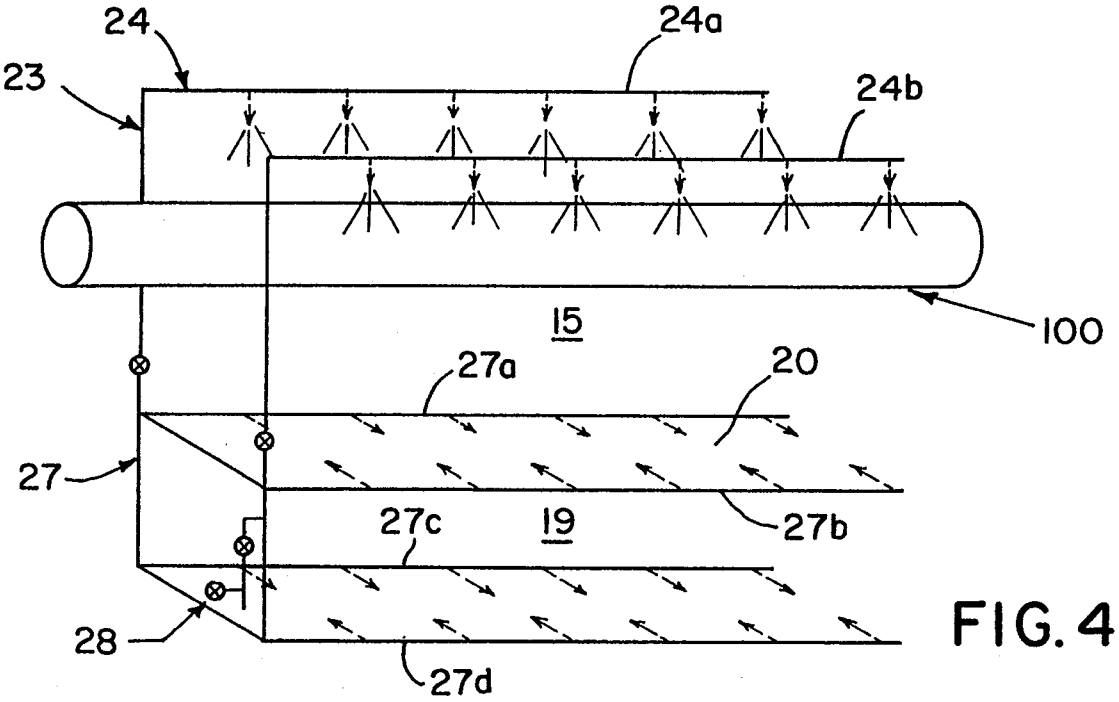
FIG. 4 is a schematic view showing the array of the spray means.

The spray means 23 also includes a further spray head 27 which includes a section for providing barrier between the first and second work zones across transfer opening 20. This spray head section includes two separate groups of spray elements 27*a* and 27*b* which are opposed to one another so that spray collides to form a fine mist. Additional groups or spray elements 27*c* and 27*d* are provided along the lower wall of the second work zone. Furthermore, spray head sections 24*a* and 24*b* provide barriers along the side wall sections of the second work zone. It will be appreciated that other spray head assemblies could be provided so that fluid barriers or curtains are arranged to totally surround the work zone. In FIG. 4 the arrows show the flow paths of the various spray heads.

The work head is further provided with a discharge chute 40 from which the material can be discharged from the second work zone and put into bags or the like. There is further provided drains 45 through which the water is removed from the apparatus.

In the particular form of apparatus as shown in FIGS. 1 to 4, the ducts 35 are operatively connected to suction fans which draw air out of the first work zone 15. Access opening 17 is opened by movement of valve closure 34. This causes large amounts of air to be drawn into the first work zone 15. The pipe section within the first work zone is then worked upon the asbestos lagging being removed therefrom. Fine dust generated by this work is controlled by the air flow through the work zone and is drawn out through ducts 35. As such, the dust and heat is being directed away from the operation. The heavy pieces of material fall or are transferred into the second work zone. The spray heads wet the material down cool as it passes into the second work zone.

Valve closure 34 is then moved to that access opening 17 is closed and access opening 21 is opened to provide access to the second work zone through transfer opening 20. The material contained within the second work zone 20 may now be transferred therefrom via chute 40 or can be bogged within the zone and there discharged through chute 40.

The above procedure can be repeated with valve closure 36 so that the rear portion of the pipe can be inspected and material removed if required.

Figure 5:
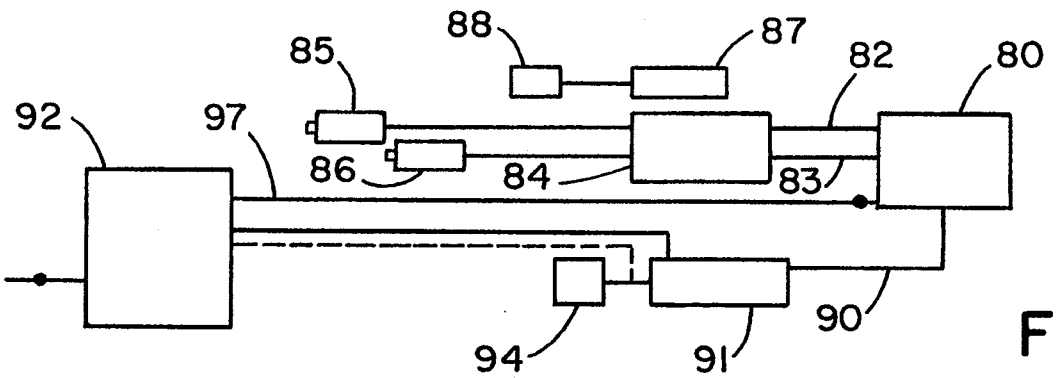
FIG. 5 is a block diagram of various elements in apparatus according to the invention.

FIG. 5 is a block diagram of the apparatus which treats or handles the air and liquid discharged from the work head of the apparatus. Essentially there are two control systems one for air and any entrained matter discharging from the first work zone and another for treating the water and entrained matter discharged from the second work zone.

Dealing firstly with the air flow control system, air (including contaminants such as fibres and water particles) is drawn out of the first work zone in the work head 80 via discharge lines 82 and 83 and is transferred to an interceptor 84 in which the airborne fibre is treated, the contaminated water is contained and the air temperature is reduced.

The interceptor 84 is connected between the work head 80 and the suction means in the form of fans 85 and 86 intercepting all gases, liquids and solids. Air entering the interceptor 84 is expanded in a spray zone, and the fine aerosols created in the spray zone remove residual airborne fibres by mutual attraction and interact with incoming contaminated water droplets. This reaction is further stimulated when the matter is forced into collision against a first precipitation deflection plate were cyclonic action and eddy currents are created condensing the contaminated water and precipitating it from the air. This may be repeated in three stages to ensure that all liquids and solids are scrubbed from the air prior to the air passing to the air suction means.

The contaminated water collected in the interceptor 84 is drawn from a storage zone in the interceptor and delivered to a liquid treatment interceptor 87. This interceptor separates the gas from the liquids and solids. A filter arrangement in the interceptor 87 separates the solids and liquid to provide water filtration the filtered water passing to a drain filter 88.

The liquid control system for controlling liquid discharged from the second work zone along line 90 includes an interceptor 91 which separates gas from the liquids and solids. In addition the interceptor is adapted to separate the solids from the liquid. The liquid can then be passed to a final filtering interceptor 92 for a further filtering procedure before passing to the drain or being redirected back for use in the spray heads in the work zone along line 97. Alternatively or in addition line 97 may supply fresh water to the system.

Figure 6:
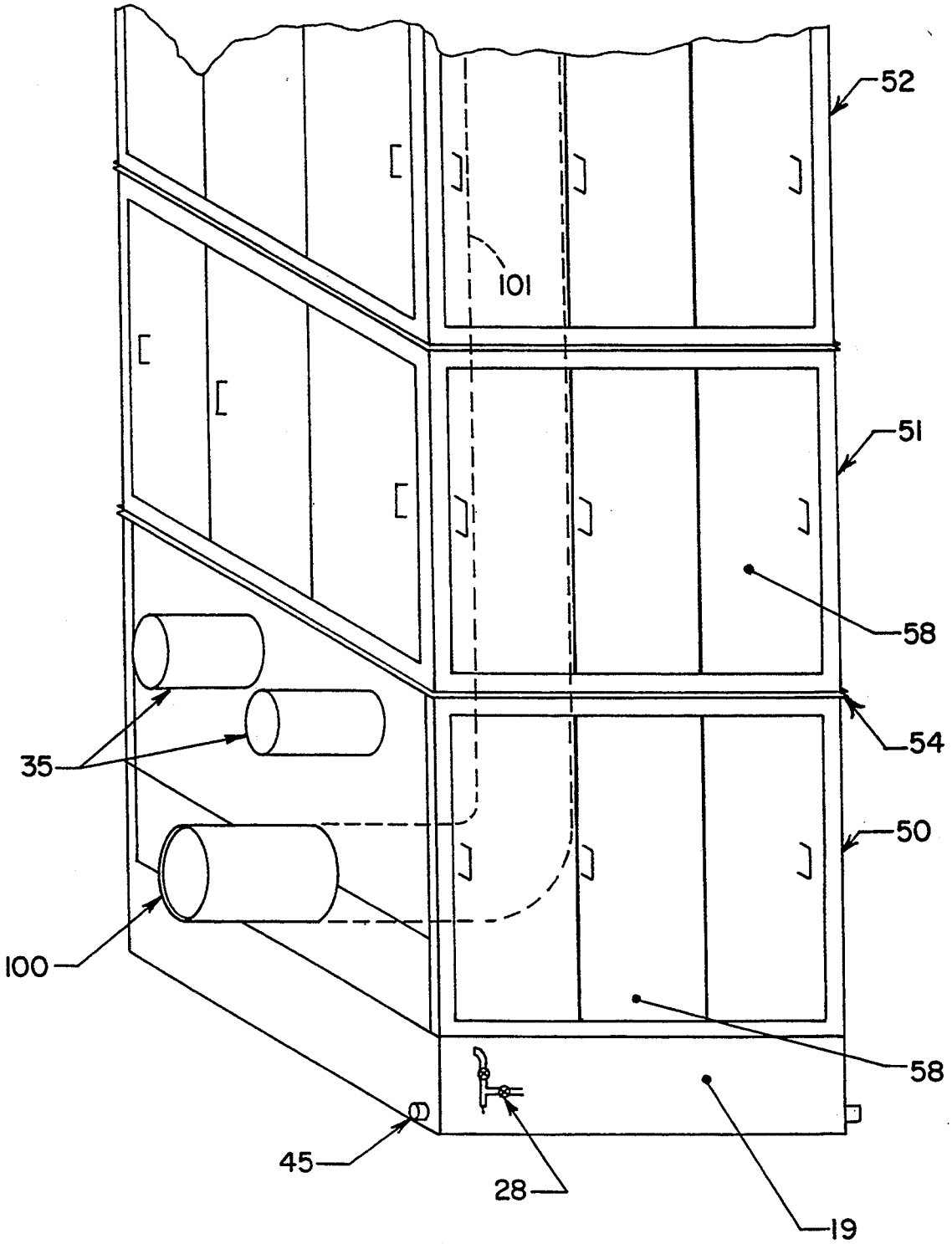
FIG. 6 is a schematic part view of apparatus according to another form of the invention.

FIG. 6 illustrates a further embodiment of apparatus according to the invention. In this embodiment the apparatus is being used in the removal of asbestos from a pipe 100 having a vertical section 101. The apparatus comprises a work head made up of a series of individual sections 50,51,52 secured together with a sealing element 54 being provided between interconnected sections. The lower part of section 50 includes the second work zone therein with the upper part of section 50 and sections 51 and 52 defining the first work zone. Ducts 35 are connected to air suction fans as has been previously described.

In this particular form of apparatus there is provided a large number of valving closures 58 in the walls of the apparatus each being selectively operable so that the air flow through the first work zone can be controlled. The second work zone is surrounded by liquid spray barriers in a similar manner to that described earlier.

Finally, it is to be understood that various alterations, modifications and or additions may be incorporated into the various constructions and arrangements of parts without departing from the spirit and ambit of the invention.

I claim:

1. Apparatus for handling potentially dangerous materials by an operator, comprising:

a work head including a main body (2) having first and second work zones therein, said first and second work zones (15,19) being arranged adjacent one another with a transfer opening (20) therebetween;

a first access opening (17) for providing access to said first work zone by said operator from externally thereof;

a second access opening (21) for providing access to said second work zone (19) by said operator from externally thereof;

an air flow generator (85,86) coupled to said first work zone for withdrawing air therefrom; and liquid spray means (23) comprising a plurality of spray heads (27) arranged so that liquid spray therefrom forms a plurality of liquid barriers or curtains which at least partially surround said second work zone including liquid barriers or curtains across said transfer opening (20) and said second access opening (21) to prevent the escape of the potentially dangerous materials from said second work zone.

2. Apparatus according to claim 1 wherein said transfer opening and said second access opening are defined by a single opening (20).

3. Apparatus according to claim 1 wherein said main body (2) comprises a base wall (4), a peripheral side wall (5) and a top (3) with a cavity within said main body, said first and second work zones (15, 19) being defined by different regions of said cavity said regions being separated by said transfer opening.

4. Apparatus according to claim 3 wherein said first work zone (15) is defined by a first region of said cavity adjacent the top and said second work zone (19) is defined by a second region of said cavity below said first region and adjacent said base wall.

5. Apparatus according to claim 3 wherein said first access opening (17) is in a first section of said peripheral side wall (5) and adjacent or near said top.

6. Apparatus according to claim 5 further including a third access opening (30) in a second section of said peripheral side wall (5) opposite to said first section of said peripheral side wall.

7. Apparatus according to claim 1 wherein said spray means (23) comprises additional spray heads (27) forming liquid spray barriers or curtains across at least some of said access openings in said first work zone.

8. Apparatus according to claim 1 wherein said air flow generator is arranged so that air is withdrawn from said first work zone in a region opposite to said first access opening.

9. Apparatus according to claim 1 wherein said main body comprises a plurality of individual sections (50, 51, 52) with said second work zone being defined in at least part of one of said sections (50).

10. Apparatus according to claim 1 further including valve closures (34, 36, 58) for selectively opening and closing said access openings for controlling the air flow through the first work zone 15.

11. Apparatus according to claim 2 wherein said main body (2) comprises a base wall (4), a peripheral side wall (5) and a top (3) with a cavity within said main body, said first and second work zones (15, 19) being defined by different regions of said cavity, said regions being separated by said transfer opening.

12. Apparatus according to claim 4 wherein said first access opening (17) is in a first section of said peripheral side wall (5) and adjacent or near said top.

13. Apparatus according to claim 2 wherein said main body comprises a plurality of individual sections (50, 51, 52) with said second work zone being defined in at least part of one of said sections (50).

* * * * *